United States Patent [19]

Steiner et al.

[11] Patent Number: 4,976,206

[45] Date of Patent: Dec. 11, 1990

[54] MECHANISM FOR THE REMOVAL OF SLAG IN INCINERATION PLANTS

[75] Inventors: Hansruedi Steiner, Wettingen; Hans Weber, Mellingen, both of Switzerland

[73] Assignee: W+E Umwelttechnik AG, Zurich, Switzerland

[21] Appl. No.: 422,966

[22] Filed: Oct. 18, 1989

[51] Int. Cl.[5] ..... E23J 1/02

[52] U.S. Cl. ..... 110/171; 110/165 R

[58] Field of Search ..... 110/171, 165 R, 170

[56] References Cited

U.S. PATENT DOCUMENTS 4,520,738 6/1985 Takehara ..... 110/171

FOREIGN PATENT DOCUMENTS 0152589 12/1984 European Pat. Off. .
974045 8/1960 Fed. Rep. of Germany .
197847 5/1923 United Kingdom ..... 110/171

*Primary Examiner*—Edward G. Favors

*Attorney, Agent, or Firm*—Helfgott & Karas

[57] ABSTRACT

A mechanism for the removal of incombustible residues from an incineration plant includes a slag shaft, a slag tank positioned under a mouth of the slag shaft and filled with water extending up to the mouth of the shaft. The incombustible residues dropping from the incineration plant furnace grate through the slag shaft collect in the slag tank and are discharged therefrom by a pusher plate via an upwardly sloping discharge path. The pusher plate is in operative connection with two thrust piston drives via two thrust rods and two rocking levers. The joint connecting the thrust rod with the rocking lever is arranged in such a way that it is not immersed in the water bath either in the rear position of the pusher plate or in the discharge position of the pusher plate. Through the direct coupling to the joint, the thrust rod and the rocking lever can operate in the same vertical plane, so that no additional moments are exerted on the rocking shaft. This leads to a longer life for the lint and also to increased operational reliability and easier maintenance.

9 Claims, 1 Drawing Sheet

MECHANISM FOR THE REMOVAL OF SLAG IN INCINERATION PLANTS

BACKGROUND OF THE INVENTION

The present invention relates to a mechanism for the removal of slag from an incineration plant, particularly for the plant for incineration of refuse or garbage, in which at the end of a furnace grate, a substantially vertically arranged slag shaft is provided, which extends via a slag tank or bath filled with water and having an upwardly sloping discharge path. A ram with a pusher plate reciprocated by a thrust piston drive is installed in the slag tank to discharge the incombustible furnace residues via the discharge path.

In all furnace and combustion plants, incombustible residues are obtained in different quantities as a function of the nature of the product burned. Particularly in the case of refuse incineration plants, the incombustible residues can constitute a relatively large proportion, particularly if there is no pre-sorting of the refuse, and consequently bulky, incombustible parts are obtained, which must be removed from the incineration plant together with all other residues.

Special slag-removing mechanisms have been typically provided for removing the incombustible residues to permit the continuous removal of the latter.

A slag-removing mechanism disclosed in DE-AS No. 2539615 can be installed in various furnace and incineration plants. The mechanism has at the end of the furnace grate a substantially vertical slag shaft, through which incombustible furnace residues drop into a slag tank located below it. This slag shaft projects into the slag tank to such an extent that its mouth is immersed in water filling the slag tank. A water seal prevents penetration of undesired air into the combustion chamber.

The slag tank passes on one side into a discharge path, through which incombustible furnace residues can be discharged from the slag tank. The residues are discharged by a discharging device referred to as a slag remover, which essentially has a pusher plate reciprocated in the slag tank. In general, the pusher plate is reciprocated by a thrust piston drive, which is in driving connection with the pusher plate by means of a correspondingly constructed linkage. As a result of the reciprocating movement of the pusher plate during each stroke in the direction of the discharge path, slag and other incombustible material are pushed towards the discharge path opening. During the stroke in the direction away from the discharge path, the material located in the vertical slag shaft can flow back into the slag tank.

In order that the water filling the tank be always at the same level, where a reliable water seal of the slag shaft is provided, a level regulating device is provided, so that the water level is kept constant. As a result of the incombustible furnace residues, particularly fine-grain ash, a sludge builds up in the water, which sludge has an abrasive action and is highly cemented and highly corrosive. As a result, those points of the ram slag remover, which are sensitive to wear, particularly bearings on the lever system immersed in the sludge, are subject to deterioration, which affects their operating characteristics. It is admittedly possible to seal bearings which are immersed in the sludge, but experience has shown that as a result of the high forces to be transferred and the deformations which occur in operation of the plant, it is not possible to ensure an absolute seal. Once such a bearing leaks, increased abrasion and correspondingly reduced operational reliability for the ram slag remover must be expected.

The known hydraulic thrust piston drive used in numerous known slag-removing mechanisms can be obviously used as the drive for the ram slag remover. In the known slag-removing mechanism (DE-AS No. 25 39 615), the ram slag remover pusher plate is reciprocated by means of two rocking levers, which are fixed to a rocking shaft extending transversely over the slag tank. One or two thrust piston drives engage on the rocking shaft and are located outside the slag tank.

In this and other known slag-removing mechanisms (Swiss patent No. 536,982), at least one of the highly loaded swivel connections of the lever system for the ram slag remover is at least temporarily immersed in the water filling the slag tank. This temporary immersion in the water, however, increases corrosion at the joints to a very considerable extent. In addition, due to the thrust piston drives positioned on the outside of the slag tank and which are laterally displaced with respect to the rocking levers, the movements of the thrust piston drives and the rocking levers take place in different planes, so that, as a result, additional moments are exerted on the rocking shaft, which leads to a corresponding dimensioning thereof.

SUMMARY OF THE INVENTION

It is an object of the present invention to provide an improved slag-removing mechanism of the aforementioned type, in which the aforementioned disadvantages are avoided. It is another object of the invention to provide a mechanism in which the immersion of joints in the water filling the slag tank and additional moments on the rocking shaft would be prevented.

According to the present invention, the aforementioned objects of the invention are attained in that a thrust piston drive is operatively connected via a linkage with a ram pusher plate and is provided with at least one thrust rod, the end of which remote from the pusher plate is located above the level of the water filling the slag tank throughout the entire pusher plate stroke. Thus, all the joints of the linkage are located outside the slag tank filled with water, and the linkage can be positioned in a relatively simple manner completely outside the slag tank. If use is made of a universal shaft, its bearing can also be located outside the water filling the tank. This arrangement makes it possible for the thrust piston drive and the thrust rod to be located in the same plane and to perform their movements in said plane for avoiding additional moments in the linkage.

The aforementioned objects, features and advantages of the invention will, in part, be pointed out with particularity, and will, in part, become obvious from the following more detailed description of the invention, taken in conjunction with the accompanying drawing, which form an integral part thereof.

DETAILED DESCRIPTION OF THE PREFERRED EMBODIMENT

Figure 1:
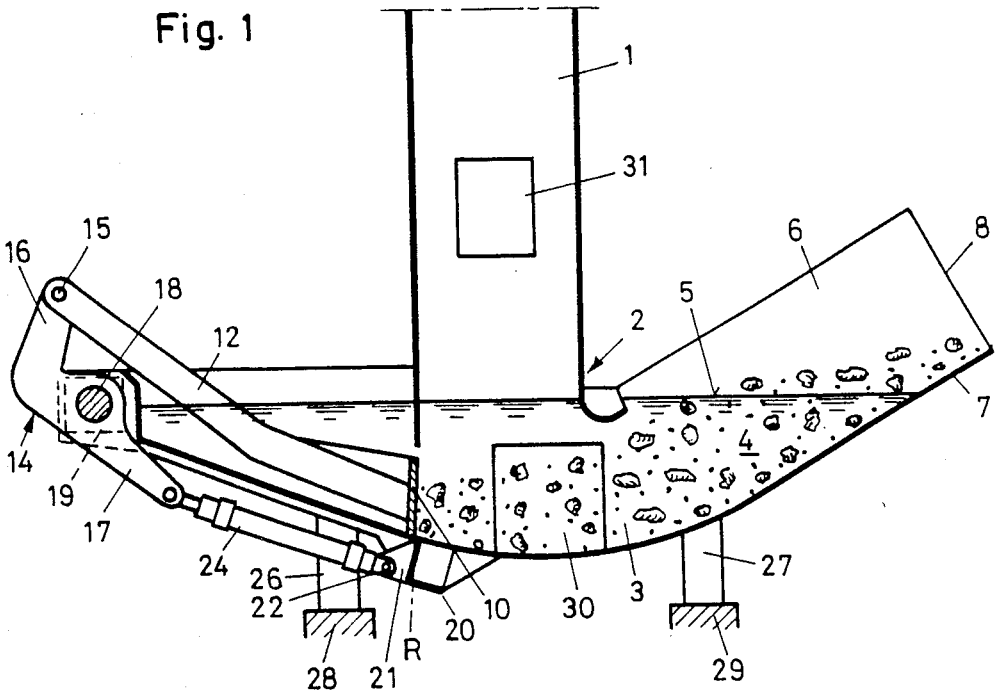
FIG. 1 is a schematic elevation view of a slag-removing mechanism with a ram slag remover, in which a pusher plate is shown in the slid-back position, whilst freeing a vertical slag shaft.
Figure 2:
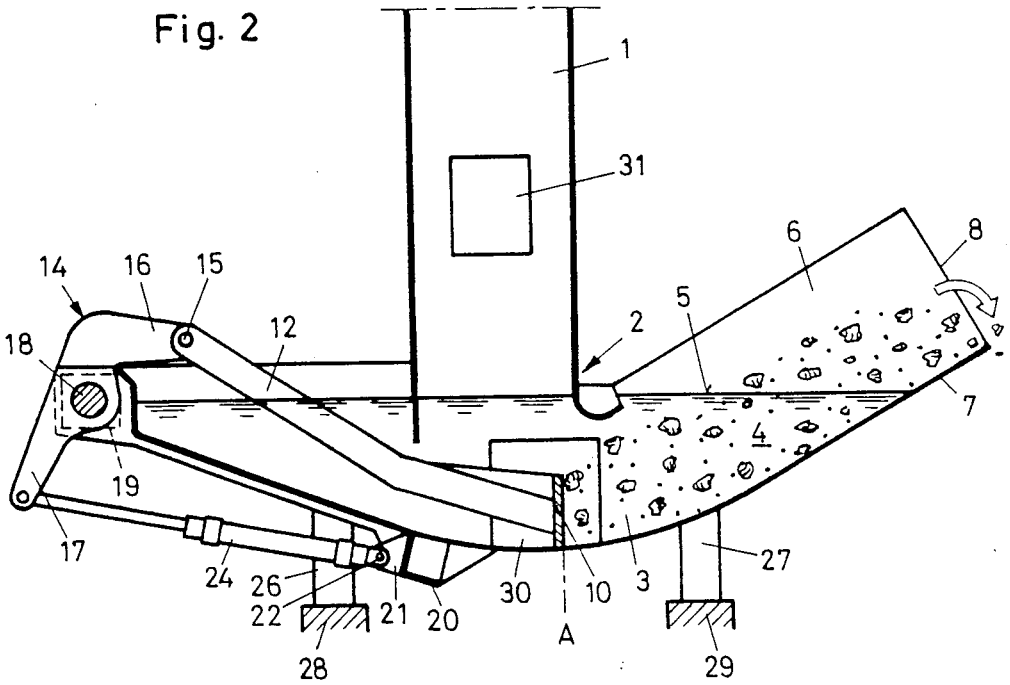
FIG. 2 is a schematic elevation view of the slag-removing mechanism according to FIG. 1, but in which the pusher plate of the ram slag remover is shown in the furthest advanced position against an upwardly sloping discharge path.

The slag-removing mechanism shown in FIGS. 1 and 2 is positioned on the end of a non-shown furnace grate of an incineration plant, in which incombustible furnace residues dropping from the grate, such as slag and other, e.g. metallic parts, pass into a vertical slag shaft 1, an opening or mouth 2 of which projects into a slag tank 3, which is filled with a water bath 4. The level of water seals the opening 2 of shaft 1 against the penetration of air. A discharge path 6 having an upwardly sloping bottom 7 is connected to or is a part of the slag tank 3. Incombustible furnace residues are discharged through an opening 8 of discharge path 6.

On the side of slag tank 3, opposite to discharge path 6, is provided a slag remover ram drive, the function of which is to move a pusher plate 10 located in slag tank 3 from a first rear position, in which the mouth 2 of the slag shaft 1 is freed, to an advanced position at the start of discharge path 6. The two positions of pusher plate 10 are designated as R for the rear position and as A for the advanced position.

On the back of pusher plate 10, is supported a thrust rod 12, which can be substantially constructed as a hollow pipe, e.g. a square hollow pipe. It is assumed in the embodiment of FIGS. 1 and 2 that two thrust rods 12 are mounted to the back of pusher plate 10, which project above the level 5 of water bath 4 and are pivotably mounted there by means of a joint 15 on a lever 14.

Lever 14 is constructed as a two-arm lever. Between arms 16 and 17 of lever 14 is arranged a rocking shaft 18. Rocking shaft 18 extends over the width of the slag tank 3 and is mounted on the outside of the front of tank 3 by means of bearings, e.g. roller bearings, in two bearing boxes 19, which can e.g. essentially form an extension of the side walls of slag tank 3.

The two-arm rocking lever 14 is fixed to the rocking shaft 18 within the two bearing boxes 19 and is aligned with the thrust rod 12. Thus, the rocking lever 14 and the thrust rod 12 are located in the same vertical plane of motion.

A support crossbar 20 is fixed to the underside of tank 3. On the support crossbar 20, is supported in each case one double link plate 21 for a rocker bearing 22 of one end of a thrust piston drive 24. Drive 24, e.g. hydraulic lift cylinder, is articulated at its other end to arm 17 of rocking lever 14 and supplies the impact force for the displacement of pusher plate 10.

FIG. 1 shows the linkage formed by the thrust rod 12 and the rocking lever 14 in the rear position of pusher plate 10. It can be seen that the joint 15 connecting thrust rod 12 to rocking lever 14 is located well above the level 5 of water bath 4 in slag tank 3. However, joint 15 is also above the level 5 of the water bath 4 in the discharge position of thrust plate 10, cf. FIG. 2. Thus, none of the joints of the thrust piston drive 24, linkage 12, 14, rocking shaft 19, which joints are sensitive to wear, are immersed in the water bath 4. In addition, the movements of linkage 12, 14 are carried out in the same vertical plane, so that no additional moments are exerted.

Slag shaft 1 and slag tank 3 are made of steel plates welded together. Pusher plate 10 slides on the inside of the bottom of slag tank 3 and moves the slag contained in the water bath toward the discharge opening 8. Slag tank 3 is normally supported on two bases 26, 27, which rest on foundations 28, 29. Thus, the slag tank 3 is located at a distance over the not shown foundation understructure, so that there is a sufficient space provided to place the thrust piston drive 24 below the slag tank 3. It is also possible to fix or hang the complete slag remover directly to the slag shaft, so that the need for foundation bases is obviated. On the both side walls, the slag tank 3 has an access door 30, which is large enough for an operator to enter the tank. Only the opening or mouth 2 of the slag shaft is connected to slag tank 3, whilst the upper part thereof is placed to the opening of the incinerator. Slag shaft 1 is also made of steel plates welded together. Slag shaft 1 is fixed to slag tank 3 and also has an access opening 31.

While particular embodiments of the present invention have been shown as described, it will be obvious to those skilled in the art that changes and modifications may be made without departing from the invention in its broader aspects. Therefore, the aim in the appended claims is to cover all changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A mechanism for the removal of slag from an incineration plant, particularly for refuse incineration, having a substantially vertically positioned slag shaft provided at one end of a furnace grate and a slag tank in communication with said shaft and having a water bath therein, and an upwardly sloping discharge path means, the mechanism comprising a ram including a pusher plate positioned in said tank; and thrust piston drive means operatively connected to said pusher plate to impart to said plate a reciprocating motion to move the slag contained in said bath towards said discharge path means, said piston drive means being positioned along an outside bottom wall of said tank and being connected to said pusher plate by means of a linkage, said linkage including at least one push rod connected at one end thereof to said pusher plate and having another end remote from said pusher plate and positioned outside of said tank and above the level of the water filling said slag tank throughout the entire stroke of said pusher plate, a rocking shaft mounted on a wall of said slag tank opposite said discharge path means, and at least one toggle lever fixed to said rocking shaft and connecting said push-rod and a piston of said thrust piston drive means to each other.

2. The mechanism according to claim 1, wherein said one end of said push rod is connected to said pusher plate to act on an end face thereof so that an opposite end face of said pusher plate pushes against the slag thus moving the slag towards a discharge opening of said tank.

3. The mechanism according to claim 2, wherein said thrust piston drive means and said push rod are located in the same plane and perform their movements in said plane thereby avoiding additional moments in the linkage.

4. The mechanism according to claim 2, wherein two push rods are connected to and act on said pusher plate and each rod is in driving connection with said thrust piston drive means.

5. The mechanism according to claim 3, wherein two push rods are connected to and act on the pusher plate and each rod is in driving connection with said thrust piston drive means.

6. The mechanism according to claim 1, wherein said toggle lever is pivotally connected to said at least one push rod, said rocking shaft being positioned in bearings which are positioned outside the water bath.

7. The mechanism according to claim 6, wherein said toggle lever includes two arms, a first arm of said lever being connected to said push rod and a second arm of said lever being connected to said piston of said thrust piston drive means.

8. The mechanism according to claim 7, wherein said drive means includes only one thrust piston drive which, by means of said first arm, drives said rocking shaft and by means of said second arm drives said push rod.

9. The mechanism according to claim 7, wherein two push rods are provided and wherein said drive means includes only one thrust piston drive which, by means of said first arm, drives said rocking shaft and by means of at least two second arms of said toggle lever drives said push rods.

* * * * *